US009704439B2

(12) United States Patent
Huang

(10) Patent No.: US 9,704,439 B2
(45) Date of Patent: Jul. 11, 2017

(54) AUTOMATIC LUMINANCE CORRECTION SYSTEM, OPTICAL GRAY SCALE MEASUREMENT DEVICE AND AUTOMATIC LUMINANCE CORRECTION METHOD

(71) Applicant: SHENZHEN CHINA STAR OPTOELECTRONICS TECHNOLOGY CO., LTD., Shenzhen, Guangdong (CN)

(72) Inventor: Wende Huang, Guangdong (CN)

(73) Assignee: SHENZHEN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 14/647,101

(22) PCT Filed: May 12, 2014

(86) PCT No.: PCT/CN2014/077222

§ 371 (c)(1),
(2) Date: May 25, 2015

(87) PCT Pub. No.: WO2015/149418

PCT Pub. Date: Oct. 8, 2015

(65) Prior Publication Data

US 2017/0011689 A1 Jan. 12, 2017

(30) Foreign Application Priority Data

Apr. 4, 2014 (CN) ..... 2014 1 0135851

(51) Int. Cl.
*G09G 3/34* (2006.01)
*G09G 3/20* (2006.01)

(52) U.S. Cl.
CPC ..... *G09G 3/3406* (2013.01); *G09G 3/2007* (2013.01); *G09G 2320/0646* (2013.01); *G09G 2360/16* (2013.01)

(58) Field of Classification Search
CPC ..... G09G 3/3406; G09G 3/2007; G09G 2320/0646; G09G 2360/16
See application file for complete search history.

(56) References Cited

U.S. PATENT DOCUMENTS

2005/0206660 A1 9/2005 Kanai
2008/0316167 A1 12/2008 Kurokawa et al.
(Continued)

FOREIGN PATENT DOCUMENTS

CN 1477614 A 2/2004
CN 1512479 A 7/2004
(Continued)

OTHER PUBLICATIONS

Rui Wang, the International Searching Authority written comments, Feb. 2015, 2015, CN.

*Primary Examiner* — Charles Hicks

(57) ABSTRACT

The present invention discloses an automatic luminance correction system, a optical gray scale measurement device and an automatic luminance correction method. The automatic luminance correction system comprises a computing unit for computing correction parameters according to the luminance-gray scale linear equation; a collecting unit for collecting the current luminance value; and a correcting unit for calculating the target luminance value according to the correction parameter and the current luminance value. By this way, the luminance of the lamp can be corrected automatically.

11 Claims, 6 Drawing Sheets

(56) References Cited

U.S. PATENT DOCUMENTS

| | | | | |
|---|---|---|---|---|
| 2009/0231256 | A1 | 9/2009 | Kim | |
| 2014/0049571 | A1* | 2/2014 | Erinjippurath .... | G02F 1/133606 345/690 |

FOREIGN PATENT DOCUMENTS

| | | | |
|---|---|---|---|
| CN | 101212704 | A | 7/2008 |
| CN | 201185077 | Y | 1/2009 |
| CN | 102667581 | A | 9/2012 |
| CN | 103310765 | A | 9/2013 |
| JP | H02271389 | A | 11/1990 |

* cited by examiner

AUTOMATIC LUMINANCE CORRECTION SYSTEM, OPTICAL GRAY SCALE MEASUREMENT DEVICE AND AUTOMATIC LUMINANCE CORRECTION METHOD

FIELD OF THE INVENTION

The invention relates to the field of liquid crystal displaying techniques, and in particular to an automatic luminance correction system, an optical gray scale measurement device and an automatic luminance correction method.

BACKGROUND OF THE INVENTION

In the product characteristics measurement of TFT-LCDs (Thin Film Transistor Liquid Crystal Display), the optical gray scale measurement devices are often used. In the product characteristics measurement, the luminance of the lamp is required to be stable, such that the gray scale of patterns outputted by TFT-LCDs are stable. By this way, patterns can be matched accurately and the characteristics values measured are stable. However, in actual product characteristics measurement, patterns matching failure and characteristics values instabilities often occur as a result of the attenuation of the lamps.

SUMMARY OF THE INVENTION

The present invention provides an automatic luminance correction system, which can correct the luminance of the lamp automatically.

The present invention is realized in such a way that: An automatic luminance correction system, the automatic luminance correction system comprising:

a computing unit for computing correction parameters according to the luminance-gray scale linear equation;

a collecting unit for collecting the current luminance value; and a correcting unit for calculating the target luminance value according to the correction parameter and the current luminance value.

Preferably, the correcting unit calculates the target luminance value based on the following equation: $X=ix+j$, wherein i is a first correction parameter, j is a second correction parameter, x is the current luminance value, X is the target luminance value.

Preferably, the automatic luminance correction system further comprising:

a gray scale obtaining unit for obtaining standard gray scale values of a standard liquid crystal panel when the luminance value of the lamp is normal and attenuation gray scale values of the standard liquid crystal panel when the luminance value of the lamp attenuates.

Preferably, the computing unit computes correction parameters according to the following luminance-gray scale linear equation: $i=(d-c)/(f-e)$; $j=(af+bc-ad-be)/(f-e)$, wherein a is a first luminance value, b is a second luminance value, c is a first standard gray scale value of the standard liquid crystal panel when the luminance value of the lamp is normal, d is a second standard gray scale value of the standard liquid crystal panel when the luminance value of the lamp is normal, e is a first attenuation gray scale value of the standard liquid crystal panel when the luminance value of the lamp attenuates, f is a second attenuation gray scale value of the standard liquid crystal panel when the luminance value of the lamp attenuates, the first standard gray scale value c and the first attenuation gray scale value e are corresponding to the first luminance value a, the second standard gray scale value d and the second attenuation gray scale value f are corresponding to the second luminance value b.

Preferably, the first luminance value a and the second luminance value b are adapted to the luminance-gray scale linear equation, and the first luminance value a is smaller than the second luminance value b.

According to another aspect of the present invention, there is provided an automatic luminance correction method, the automatic luminance correction method comprising the steps of:

a computing step for computing correction parameters according to the luminance-gray scale linear equation;

a collecting step for collecting the current luminance value; and a correcting step for calculating the target luminance value according to the correction parameter and the current luminance value.

Preferably, the correcting step the target luminance value is calculated based on the following equation: $X=ix+j$, wherein i is a first correction parameter, j is a second correction parameter, x is the current luminance value, X is the target luminance value.

Preferably, the computing step comprises:

a gray scale obtaining step for obtaining standard gray scale values of a standard liquid crystal panel when the luminance value of the lamp is normal and attenuation gray scale values of the standard liquid crystal panel when the luminance value of the lamp attenuates.

Preferably, in the computing step the correction parameters are computed according to the following luminance-gray scale linear equation: $i=(d-c)/(f-e)$; $j=(af+bc-ad-be)/(f-e)$, wherein a is a first luminance value, b is a second luminance value, c is a first standard gray scale value of the standard liquid crystal panel when the luminance value of the lamp is normal, d is a second standard gray scale value of the standard liquid crystal panel when the luminance value of the lamp is normal, e is a first attenuation gray scale value of the standard liquid crystal panel when the luminance value of the lamp attenuates, f is a second attenuation gray scale value of the standard liquid crystal panel when the luminance value of the lamp attenuates, the first standard gray scale value c and the first attenuation gray scale value e are corresponding to the first luminance value a, the second standard gray scale value d and the second attenuation gray scale value f are corresponding to the second luminance value b.

Preferably, the first luminance value a and the second luminance value b are adapted to the luminance-gray scale linear equation, and the first luminance value a is smaller than the second luminance value b.

According to yet another aspect of the present invention, there is provided an optical gray scale measurement device, the optical gray scale measurement device comprises the above-mentioned automatic luminance correction system.

According to the present invention, the automatic luminance correction system comprises a computing unit, a collecting unit and a correcting unit, the computing unit is used to compute the correction parameters according to the luminance-gray scale linear equation, the collecting unit is used to collect the current luminance value x, the correcting unit is used to calculate the target luminance value X according to the correction parameters and the current luminance value x. By this way, the luminance of the lamp can be corrected automatically.

For more clearly and easily understanding above content of the present invention, the following text will take a preferred embodiment of the present invention with reference to the accompanying drawings for detail description as follows.

BRIEF DESCRIPTION OF THE DRAWINGS

The drawings described herein are for illustration purposes only and are not intended to limit the scope of the present disclosure in any way.

DETAILED DESCRIPTION OF THE PREFERRED EMBODIMENTS

The embodiments of the present invention will be described in detail with reference to the accompanying drawings.

Figure 1:
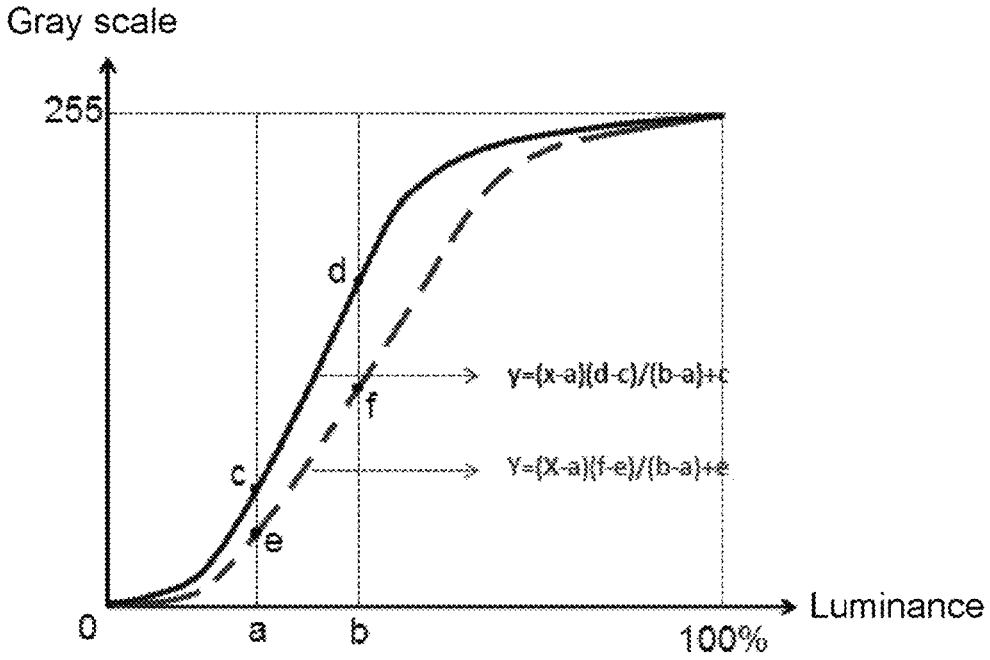
FIG. 1 is a schematic view illustrating the luminance-gray scale standard curve (solid line) when the luminance value of the lamp is normal and the luminance-gray scale attenuation curves (dashed line) when the luminance value of the lamp attenuates.
Figure 2:
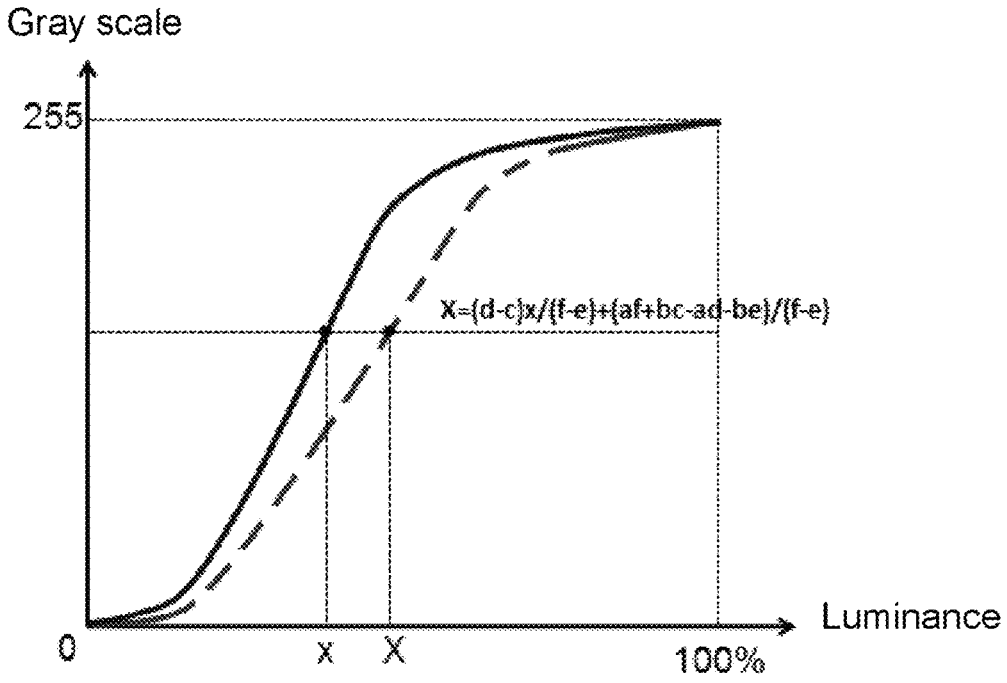
FIG. 2 is a schematic view illustrating the curves for calculating the target luminance value according to the correction parameter and the current luminance value to provide a standard pattern gray scale when the luminance value of the lamp attenuates.

The luminance-gray scale curves will be described with reference to FIG. 1 and FIG. 2. The mapping relationship between luminance and the gray scale can be seen in FIG. 1 and FIG. 2. In FIG. 1 and FIG. 2, the luminance is expressed in percentage, and the range of the gray scale is 0-255 (from black to white). In the product characteristics measurement of TFT-LCDs, the range of the gray scale is generally between 78 and 178, the range of the luminance is generally between 20% and 50%. When the gray scale is between 50 and 200, the relationship between the luminance and the gray scale is substantially linear. Thus, the luminance-gray scale linear equation can be used to measure the gray scale the in optical gray scale measurement device.

In the automatic luminance correction system of present embodiment, standard liquid crystal panels are used. The standard liquid crystal panels may be glass. The size of the standard liquid crystal panels may be about 5 cm×5 cm. The standard liquid crystal panels should be separated from the liquid crystal panels to be measured, such as to avoid interference with the liquid crystal panels to be measured and scratch of the liquid crystal panels to be measured.

A first luminance value a and a second luminance value b is selected when the luminance value of the lamp is normal. Then a first standard gray scale value c of the standard liquid crystal panel under the first luminance value a is measured, and a second standard gray scale value d of the standard liquid crystal panel under the second luminance value b is measured. Preferably, the first luminance value a is the minimum value of the luminance in the product characteristics measurement, the second luminance value b is the maximum value of the luminance in the product characteristics measurement. Moreover, the first luminance value a and the second luminance value b is in the range of the luminance-gray scale linear region. In this situation, the luminance-gray scale standard curve shown by the solid line can be expressed by the following first linear equation: $y=(x-a)(d-c)/(b-a)+c$, wherein y denotes gray scale value (longitudinal coordinate), x denotes luminance value (horizontal coordinate).

In the case of lamp attenuation, a first attenuation gray scale value e of the standard liquid crystal panel under the first luminance value a is measured, and a second attenuation gray scale value f of the standard liquid crystal panel under the second luminance value b is measured. In this situation, the luminance-gray scale attenuation curve shown by the dashed line can be expressed by the following second linear equation: $Y=(X-a)(f-e)/(b-a)+e$, wherein Y denotes gray scale value (longitudinal coordinate), X denotes luminance value (horizontal coordinate).

Based on the above-mentioned first linear equation and the above-mentioned second linear equation, the following equation can be figured out when $Y=y$ is set: $X=(d-c)x/(f-e)+(af+bc-ad-be)/(f-e)$, as shown in FIG. 2. The equation can be simplified as $X=ix+j$, wherein $i=(d-c)/(f-e)$; $j=(af+bc-ad-be)/(f-e)$, i is a first correction parameter, j is a second correction parameter, x is the current luminance value, X is the target luminance value. By this way, in the case of lamp attenuation, the target luminance value can be figured out according to the correction parameters and the current luminance value to provide a standard pattern gray scale.

The automatic luminance correction system, an optical gray scale measurement device and an automatic luminance correction method according to the present invention are provided based on the above-mentioned theory.

Figure 3:
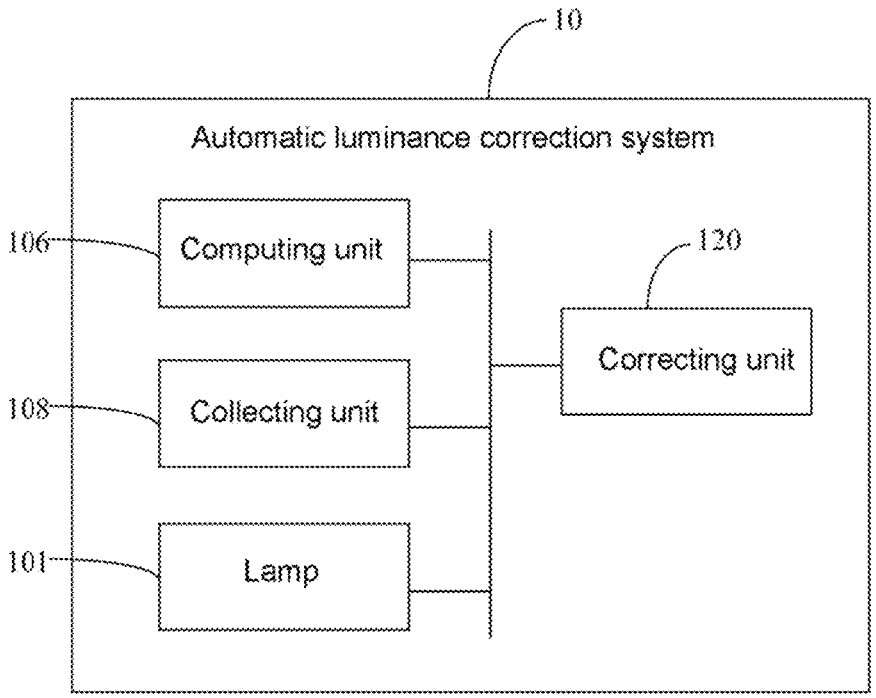
FIG. 3 is a schematic block view of the automatic luminance correction system according to one embodiment of the present invention.

As shown in FIG. 3, the automatic luminance correction system 10 in the present embodiment comprises a lamp 101, a computing unit 106, a collecting unit 108 and a correcting unit 120. The computing unit 106 is used to compute the correction parameters according to the luminance-gray scale linear equation. The collecting unit 108 is used to collect the current luminance value x. The correcting unit 120 is used to calculate the target luminance value X according to the correction parameters and the current luminance value x. The correcting unit 120 calculates the target luminance value X based on the equation $X=ix+j$ as described. Wherein i is a first correction parameter, j is a second correction parameter, the first correction parameter i and the second correction parameter j can be obtained in advance and predetermined.

Figure 4:
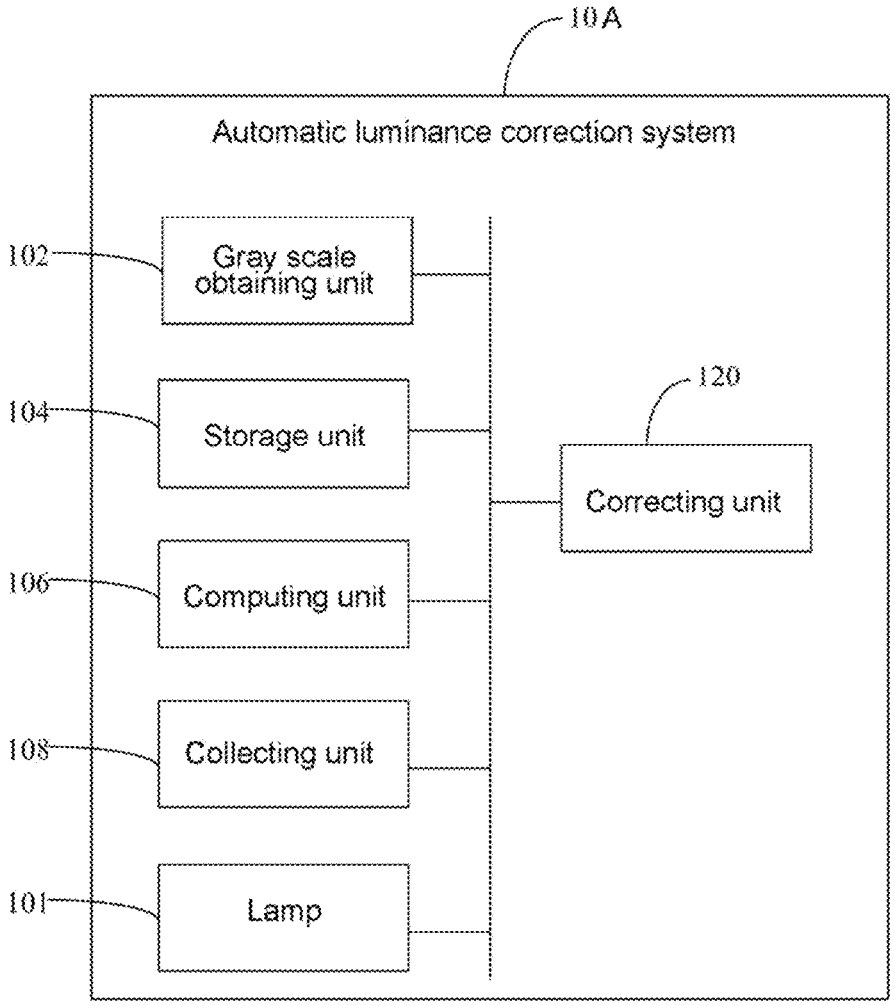
FIG. 4 is a schematic block view of the automatic luminance correction system according to another embodiment of the present invention.

As shown in FIG. 4, the automatic luminance correction system 10A in another embodiment comprises a lamp 101, a gray scale obtaining unit 102, a storage unit 104, a computing unit 106, a collecting unit 108 and a correcting unit 120. The gray scale obtaining unit 102 is used to obtain standard gray scale values (i.e. the first standard gray scale value c and the second standard gray scale value d) of a standard liquid crystal panel when the luminance value of the lamp is normal and attenuation gray scale values (i.e. the first attenuation gray scale value e and the second attenuation gray scale value f) of the standard liquid crystal panel when the luminance value of the lamp attenuates. The storage unit 104 is used to save the first luminance value a, the second luminance value b, the first standard gray scale value c, the second standard gray scale value d, the first attenuation gray scale value e, the second attenuation gray scale value f, the first correction parameter i and the second correction parameter j, the equation X=ix+j, and other programs and the like.

According to yet another aspect of the present invention, there is provided an optical gray scale measurement device. The optical gray scale measurement device comprises the above-mentioned automatic luminance correction system.

Figure 5:
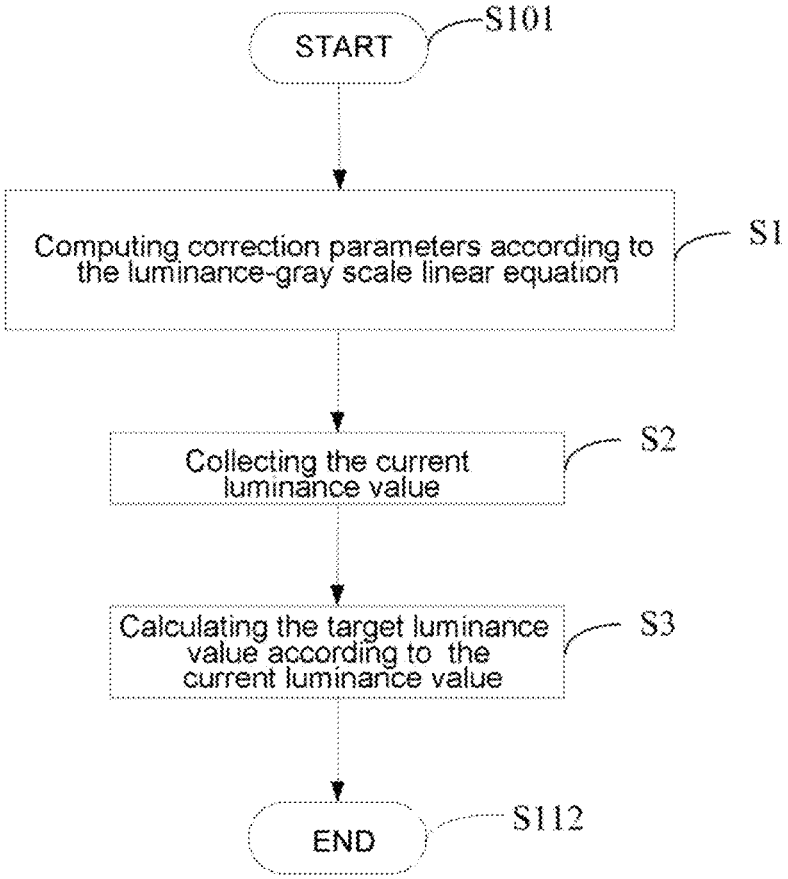
FIG. 5 is a schematic flowchart of the automatic luminance correction method according to one embodiment of the present invention.

As shown in FIG. 5, the automatic luminance correction method according to the present invention comprises a starting step S101, a computing step S1, a collecting step S2, a correcting step S3 and a ending step S112. The computing step S1 is used to compute the correction parameters (i.e. the first correction parameter i and the second correction parameter j) according to the luminance-gray scale linear equation. The collecting step S2 is used to collect the current luminance value x. The correcting step S3 is used to calculate the target luminance value X according to the correction parameters and the current luminance value x.

Figure 6:
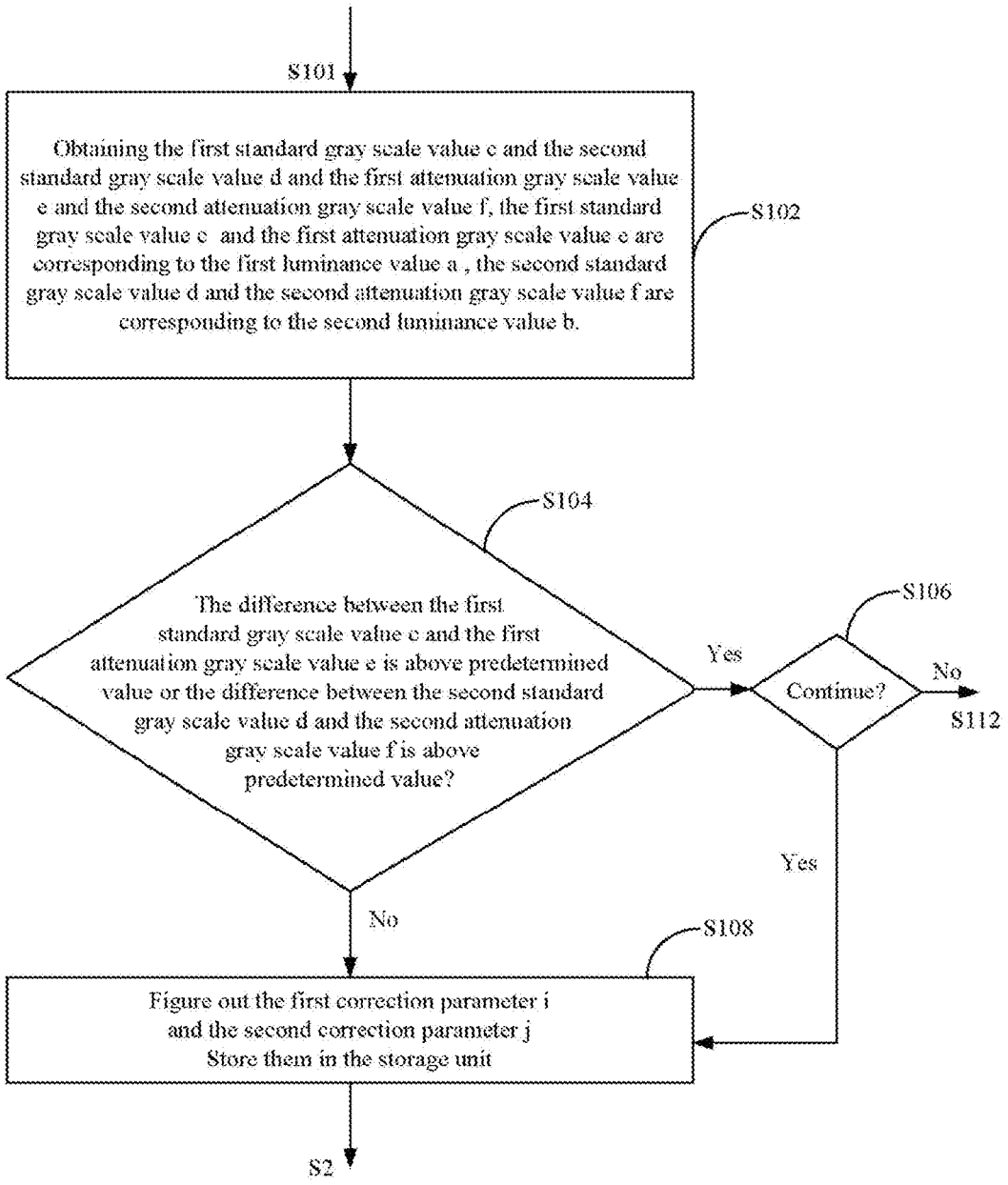
FIG. 6 is a schematic flowchart of part of the automatic luminance correction method according to another embodiment of the present invention.

As shown in FIG. 6, The computing step S1 comprises a gray scale obtaining step S102, a mistake proofing step S104, a manual handling step S106 and a correction parameter computing step S108.

The gray scale obtaining step S102 is used to obtain standard gray scale values (i.e. the first standard gray scale value c and the second standard gray scale value d) of a standard liquid crystal panel when the luminance value of the lamp is normal and attenuation gray scale values (i.e. the first attenuation gray scale value e and the second attenuation gray scale value f) of the standard liquid crystal panel when the luminance value of the lamp attenuates. The first standard gray scale value c and the first attenuation gray scale value e are corresponding to the first luminance value a, the second standard gray scale value d and the second attenuation gray scale value f are corresponding to the second luminance value b. In the mistake proofing step S104, it is determined whether the difference between the first standard gray scale value c and the first attenuation gray scale value e is above predetermined value such as 50 or not and the difference between the second standard gray scale value d and the second attenuation gray scale value f is above predetermined value such as 50 or not. If the difference between the first standard gray scale value c and the first attenuation gray scale value e is above predetermined value or the difference between the second standard gray scale value d and the second attenuation gray scale value f is above predetermined value, then the manual handling step S106 is performed. In the manual handling step S106, an alarm can be activated and operators decide to continue to correct (perform the correction parameter computing step S108) or cancel correcting (perform the ending step S112). If the difference between the first standard gray scale value c and the first attenuation gray scale value e is below predetermined value or the difference between the second standard gray scale value d and the second attenuation gray scale value f is below predetermined value, then the correction parameter computing step S108 is performed, the first correction parameter i and the second correction parameter j are figured out.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. An automatic luminance correction system, the automatic luminance correction system comprising:

a computing unit for computing correction parameters according to a luminance-gray scale linear equation;

a collecting unit for collecting the current luminance value; and a correcting unit for calculating the target luminance value according to the correction parameter and the current luminance value;

wherein the correcting unit calculates the target luminance value based on the following equation: X=ix+j, wherein i is a first correction parameter, j is a second correction parameter, x is the current luminance value, X is the target luminance value; and the computing unit computes correction parameters according to the following luminance-gray scale linear equation: i=(d−c)/(f−e); j=(af+bc−ad−be)/(f−e), wherein a is a first luminance value, b is a second luminance value, c is a first standard gray scale value of the standard liquid crystal panel when the luminance value of the lamp is normal, d is a second standard gray scale value of the standard liquid crystal panel when the luminance value of the lamp is normal, e is a first attenuation gray scale value of the standard liquid crystal panel when the luminance value of the lamp attenuates, f is a second attenuation gray scale value of the standard liquid crystal panel when the luminance value of the lamp attenuates, the first standard gray scale value c and the first attenuation gray scale value e are corresponding to the first luminance value a, the second standard gray scale value d and the second attenuation gray scale value f are corresponding to the second luminance value b.

2. The automatic luminance correction system of claim 1, wherein the automatic luminance correction system further comprising:

a gray scale obtaining unit for obtaining standard gray scale values of a standard liquid crystal panel when the luminance value of the lamp is normal and attenuation gray scale values of the standard liquid crystal panel when the luminance value of the lamp attenuates.

3. The automatic luminance correction system of claim 1, wherein the first luminance value a and the second luminance value b are adapted to the luminance-gray scale linear equation, and the first luminance value a is smaller than the second luminance value b.

4. An automatic luminance correction method, the automatic luminance correction method comprising the steps of:

a computing step for computing correction parameters according to a luminance-gray scale linear equation;

a collecting step for collecting the current luminance value, wherein the correction parameters are computed according to the following luminance-gray scale linear equation: i=(d−c)/(f−e); j=(af+bc−ad−be)/(f−e), wherein a is a first luminance value, b is a second luminance value, c is a first standard gray scale value of the standard liquid crystal panel when the luminance value of the lamp is normal, d is a second standard gray scale value of the standard liquid crystal panel when the luminance value of the lamp is normal, e is a first attenuation gray scale value of the standard liquid crystal panel when the luminance value of the lamp attenuates, f is a second attenuation gray scale value of the standard liquid crystal panel when the luminance value of the lamp attenuates, the first standard gray scale value c and the first attenuation gray scale value e are corresponding to the first luminance value a, the second standard gray scale value d and the second attenuation gray scale value f are corresponding to the second luminance value b; and a correcting step for calculating the target luminance value according to the correction parameter and the current luminance value, wherein the target luminance value is calculated based on the following equation: $X=ix+j$, wherein i is a first correction parameter, j is a second correction parameter, x is the current luminance value, X is the target luminance value.

5. The automatic luminance correction method of claim 4, wherein the computing step comprises:

a gray scale obtaining step for obtaining standard gray scale values of a standard liquid crystal panel when the luminance value of the lamp is normal and attenuation gray scale values of the standard liquid crystal panel when the luminance value of the lamp attenuates.

6. The automatic luminance correction method of claim 4, wherein the first luminance value a and the second luminance value b are adapted to the luminance-gray scale linear equation, and the first luminance value a is smaller than the second luminance value b.

7. An optical gray scale measurement device, the optical gray scale measurement device comprising an automatic luminance correction system, the automatic luminance correction system comprising:

a computing unit for computing correction parameters according to a luminance-gray scale linear equation, wherein the computing unit computes correction parameters according to the following luminance-gray scale linear equation: $i=(d-c)/(f-e)$; $j=(af+bc-ad-be)/(f-e)$, wherein a is a first luminance value, b is a second luminance value, c is a first standard gray scale value of the standard liquid crystal panel when the luminance value of the lamp is normal, d is a second standard gray scale value of the standard liquid crystal panel when the luminance value of the lamp is normal, e is a first attenuation gray scale value of the standard liquid crystal panel when the luminance value of the lamp attenuates, f is a second attenuation gray scale value of the standard liquid crystal panel when the luminance value of the lamp attenuates, the first standard gray scale value c and the first attenuation gray scale value e are corresponding to the first luminance value a, the second standard gray scale value d and the second attenuation gray scale value f are corresponding to the second luminance value b;

a collecting unit for collecting the current luminance value; and a correcting unit for calculating the target luminance value according to the correction parameter and the current luminance value, wherein the correcting unit calculates the target luminance value based on the following equation: $X=ix+j$, wherein i is a first correction parameter, j is a second correction parameter, x is the current luminance value, X is the target luminance value.

8. The optical gray scale measurement device of claim 7, wherein the automatic luminance correction system further comprising:

a gray scale obtaining unit for obtaining standard gray scale values of a standard liquid crystal panel when the luminance value of the lamp is normal and attenuation gray scale values of the standard liquid crystal panel when the luminance value of the lamp attenuates.

9. The optical gray scale measurement device of claim 7, wherein the first luminance value a and the second luminance value b are adapted to the luminance-gray scale linear equation, and the first luminance value a is smaller than the second luminance value b.

10. The automatic luminance correction system of claim 1, wherein the computing unit determines whether a difference between the first standard gray scale value c and the first attenuation gray scale value e is greater than a predetermined value and a difference between the second standard gray scale value d and the second attenuation gray scale value f is greater than a predetermined value.

11. The automatic luminance correction system of claim 10, wherein when the difference between the first standard gray scale value c and the first attenuation gray scale value e is greater than the predetermined value or the difference between the second standard gray scale value d and the second attenuation gray scale value f is greater than the predetermined value, an alarm is activated.

* * * * *